US005443017A

United States Patent [19]

Wacker et al.

[11] Patent Number: 5,443,017

[45] Date of Patent: Aug. 22, 1995

[54] ADJUSTABLE WORK TABLE AND MODULAR SYSTEM FOR THE ASSEMBLY THEREOF

[75] Inventors: Robert W. Wacker, Plymouth; Ronald J. Smieś, Oostburg; Ronald K. LaFond, Manitowoc; Dale M. Hemberger, Sheboygan, all of Wis.

[73] Assignee: Mayline Company, Inc., Sheboygan, Wis.

[21] Appl. No.: 101,595

[22] Filed: Jul. 30, 1993

Related U.S. Application Data

[63] Continuation-in-part of Ser. No. 858,945, Mar. 27, 1992, abandoned.

[51] Int. Cl.[6] ..... A47F 5/12

[52] U.S. Cl. ..... 108/3; 108/147; 108/5; 108/50; 312/194

[58] Field of Search ..... 312/223.1, 194, 196; 108/50, 5, 3, 10, 147

[56] References Cited

U.S. PATENT DOCUMENTS

| | | | |
|---|---|---|---|
| 307,962 | 11/1884 | Kossbiel | 108/5 |
| 694,401 | 3/1902 | Marsolais | 108/50 |
| 4,440,096 | 4/1984 | Rice et al. | 108/3 |
| 4,469,029 | 9/1984 | Raymond | 108/3 |
| 5,224,429 | 7/1993 | Borgman et al. | 108/50 |

FOREIGN PATENT DOCUMENTS

| | | | |
|---|---|---|---|
| 934419 | 5/1948 | France | 108/3 |

OTHER PUBLICATIONS

Mayline Company Brochure, May 27, 1992.

*Primary Examiner*—Michael J. Milano

*Attorney, Agent, or Firm*—Andrus, Sceales, Starke & Sawall

[57] ABSTRACT

A modular work station includes a dual column construction with a separately adjustable work surface supported on each column. Each of the columns utilizes a tubular telescoping construction and can provide as many as three individual modes of adjustable movement to the work surface, including lift, tilt, and horizontal back and forth movements. Supporting columns can be selected with varying functions to provide extremely broad versatility. The lift and tilt functions are preferably provided by motor driven linear actuators mounted within the telescoping column with appropriate controls to prevent contact between adjacent work surfaces when one or both of the surfaces is also provided with back and forth sliding movement.

4 Claims, 5 Drawing Sheets

ADJUSTABLE WORK TABLE AND MODULAR SYSTEM FOR THE ASSEMBLY THEREOF

This is a continuation-in-part of U.S. Ser. No. 07/858,945, filed Mar. 27, 1992, now abandoned.

BACKGROUND OF THE INVENTION

The present invention relates to work stations utilizing a pair of independently adjustable work surfaces and to a modular assembly system for such work stations.

Raisable and lowerable tables are well known to the art, for example, the Trakker adjustable table manufactured by Haworth Inc., and many other examples.

It is also known to provide means to a raisable and lowerable table for tilting the table top toward the user in an adjustable manner.

By the present invention, a table, typically a desk-like work table, is rendered more useful and desirable for computer aided design and other work activities by providing a pair of raisable and lowerable, separate table tops to provide a two level table, if desired, in which the rear table top is capable of tilting through any of a range of pivoted positions on both sides of the horizontal position of the table top. Thus, the table top can be tilted toward the user, but, for monitor eye angle to avoid light glare or the like, the same table top can be tilted through the horizontal position to tilt rearwardly from the user to a certain degree, which provides great versatility of use for a large variety of purposes.

To provide a fully functional work station, the forward table top should also be capable of tilting movement about a horizontal axis and, furthermore, it has been found that sliding movement of one or both of the work surfaces in a direction in the plane of the surface provides further flexibility to the work station. However, providing simple and effective control of these various movements in a safe and efficient manner has not previously been attained in a dual surface work station.

DESCRIPTION OF THE INVENTION

In accordance with the present invention, a raisable and lowerable table is provided, which table comprises a base, a movably extensible vertical column attached to the base, a table top is carried on the vertical column, and pivot means for moving the table top into any of a range of pivoted positions on both sides of the horizontal position of the table top. Means are also provided for holding the table top in any of said range of pivoted positions.

Additionally, it is contemplated by this invention that a pair of vertical columns may be attached to the base, each vertical column carrying a separate, pivotally attached table top for independent raising and lowering of each such table top. Thus, the same table may comprise a substantially flat surface, where both table tops are in a horizontal position at the same height. If desired, the rear table top may be raised relative to the forward table top from the position that the user is standing, with either of a table tops being in a position angled from the horizontal, or, if desired, in the horizontal position. Thus, a versatile table is provided which is suitable for a multitude of different uses.

Further by this invention, separate, motor-driven means are provided (1) to extend and retract the vertical column or columns, and (2) to pivotally move and to hold the table top or table tops in any of the range of pivoted positions. Accordingly, the pivoting of the table tops and their vertical elevations may be selected in a manner that is entirely independent of each other, for the above-described, to provide great flexibility of use of the table of this invention.

Substantially greater utility and versatility has been added to the dual surface work station of the present invention by providing one or both work surfaces or table tops with a slide capability allowing the surface to be moved relative to its supporting column or the other work surface in a direction in the plane of the surface being moved. Thus, in one aspect of the invention, a work station includes a pair of independently adjustable work surfaces each of which is supported by a separate vertically telescoping column that includes a movable upper tubular column member and a fixed lower tubular column member, with the columns supported on a common base. The work station includes adjustable mounting means for attaching each work surface to the upper end of its column member. First linear actuator means are secured within each lower column member to extend upwardly through the upper column member and into operative engagement with the mounting means to move the attached work surface vertically. The second linear actuator means is secured within each upper column member to extend upwardly into operative engagement with the mounting means to pivot the attached work surface about a horizontal axis parallel to the surface. In addition, the mounting means for at least one of the work surfaces includes means for moving the work surface relative to its supporting column in a direction in the plane of that surface.

In a preferred embodiment, the work surfaces comprise a pair of table tops having parallel adjacent edges. The moving means for the respective columns includes lockout means to disenable operation of both of the linear actuator means in response to movement of one of the adjacent edges of a table top through a vertical plane containing the adjacent edge of the other table top.

In a somewhat broader and more basic aspect of the subject invention, a single work station has a three-way adjustably positionable work surface which is supported on a vertically telescoping column including a movable upper tubular column member and a fixed lower tubular column member, the lower tubular column member being attached to a supporting base. Adjustable mounting means is provided to attach the work surface to the upper end of the upper column member. First linear actuator means is secured within the lower column member and extends upwardly through the upper column member into operative connection with the mounting means to move the attached work surface vertically. Second linear actuator means is secured within the upper column member and extends upwardly into operative connection with the mounting means to pivot the attached work surface about a horizontal axis. The mounting means further includes means for moving the work surface with respect to its supporting column in a direction in the plane of the surface.

When applied to a dual surface work station, the three-way adjustability of the basic work station of the present invention lends itself to a modular system for assembling work stations having a pair of independent adjustable work surfaces in a manner providing extremely broad flexibility, allowing dual surface adjustable work stations to be custom assembled to accommodate a wide range of specific applications. The modular system for assembling such work stations utilizes the telescoping tubular column construction with the columns supported on a common base. The base includes a pair of laterally spaced legs and a pair of parallel spreaders extending between the legs, each spreader adapted to receive and to have attached to it the lower end of the lower member of each column. The assembly also includes mounting means for attaching a work surface to the upper end of the upper member of each column. In accordance with the modular assembly system of the present invention, each of the columns is selected from a group which consists of (1) a first column which has a linear actuator to provide vertical lift to the work surface interconnecting the lower column member and the mounting means, and (2) a second column having a combination of the lift actuator and a linear actuator for tilting the work surface about a horizontal axis interconnecting the upper column member and the mounting means. Each of the mounting means is, in turn, selected from a group which consists of (1) first mounting means attaching the work surface to the column in a horizontally fixed position, (2) second mounting means pivotally attaching the work surface to the column for tilting movement about a horizontal axis parallel to the surface, and (3) third mounting means selected from a subgroup which consists of (a) a combination of the first mounting means and a slide mechanism which provides movement of the work surface in a direction in the plane of the surface, and (b) a combination of the second mounting means and the slide mechanism.

Each of the first and second columns is preferably provided with a generally rectangular horizontal cross section defined by the concentric interfitting rectangular cross sections of the upper and lower tubular column members. Each of the second columns has a larger horizontal cross section than the first columns, and the spreaders for supporting the columns are provided with upwardly opening adjustable rectangular slot means which is adapted to receive and enclose the lower end of the lower column member of either of the first and second columns.

DETAILED DESCRIPTION OF THE PREFERRED EMBODIMENTS

Figure 1:
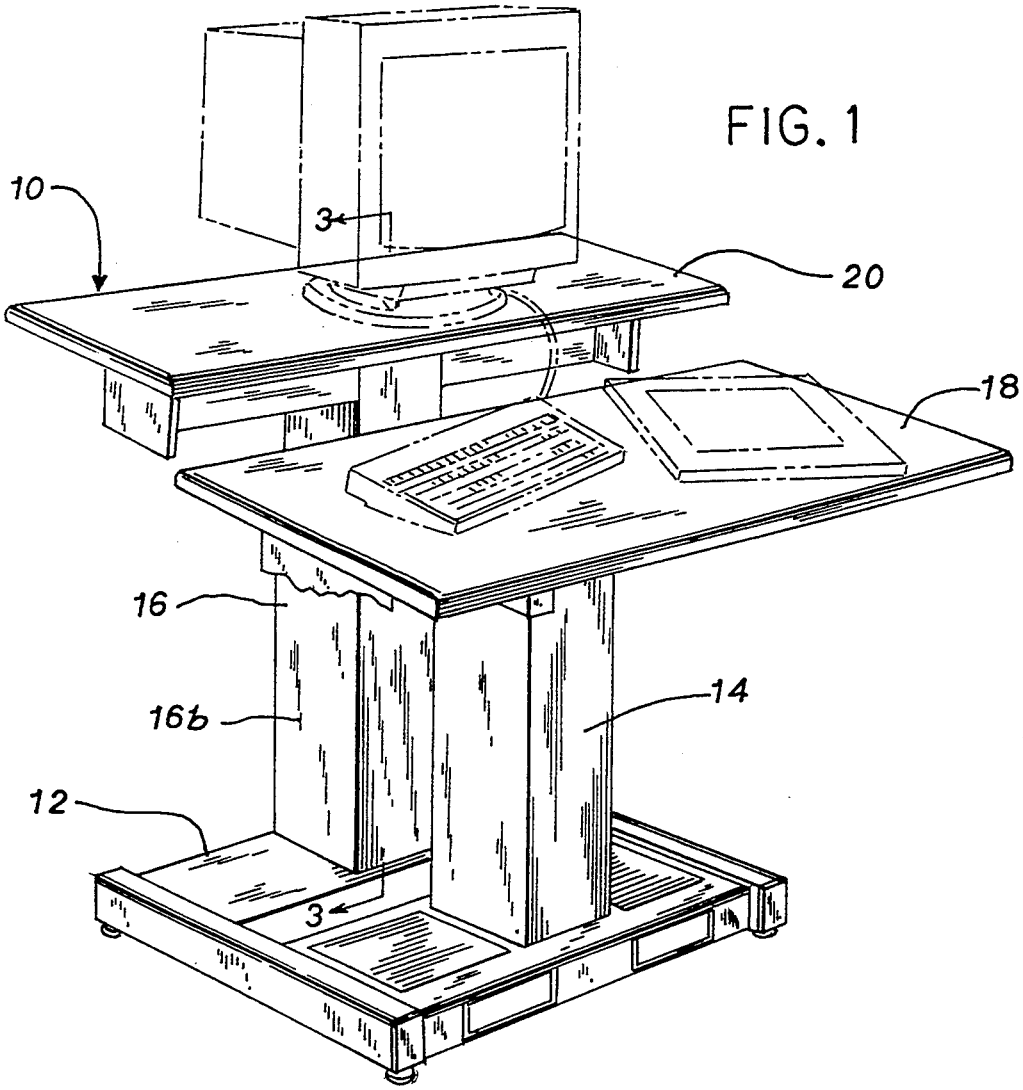
FIG. 1 is a perspective view of a work table in accordance with this invention.

Referring to the drawings, adjustable work table 10 is shown comprising base 12 of conventional design, and a pair of vertical columns 14,16, each of which respectively carries a table top 18,20.

Figure 2:
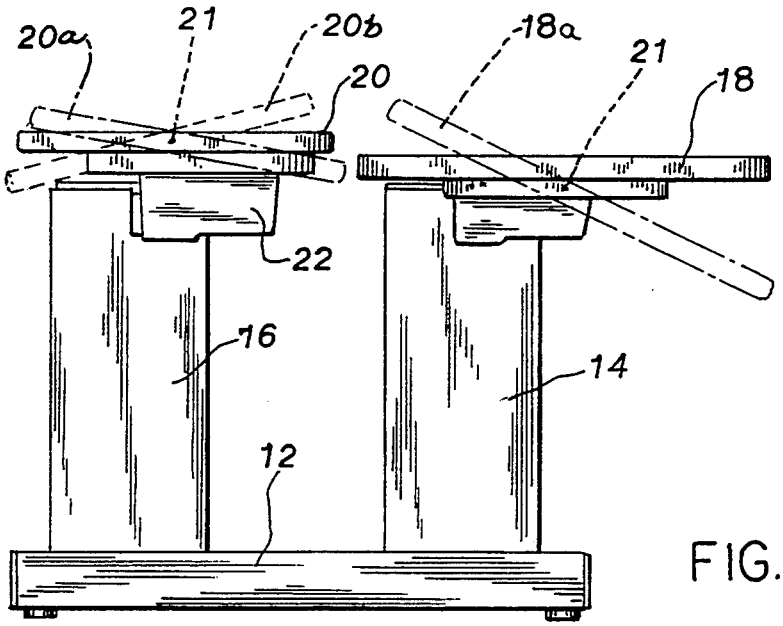
FIG. 2 is an elevational view of the work table of FIG. 1, showing various pivoting positions of the table tops present.

Each column 14,16 is independently capable of raising the respective table top 18,20 that it carries to a varying, desired height, as illustrated in FIG. 1, with such varying height being different from the respective heights of table tops 18,20, shown in the same table in FIG. 2.

Pivot means 21 are provided to each table top 18,20 for moving the respective table tops in an independent manner into any of a range of pivoted positions as illustrated in FIG. 2 by the respective dotted line positions 18*a*,20*a* of the respective table tops.

Furthermore, table top 20 is capable of pivoting through the horizontal into a reverse pivoting positions 20*b*, which provides a desirable increased utility for the table, to facilitate drawing while the user is standing, for example, in a manner which may facilitate his drawing activity and may avoid glare from overhead lights. But in the particular embodiment shown, table top 18 moves only between the horizontal position of table top 18 and the pivoted position 18*a*.

Referring particularly to FIGS. 3–7, the working details of column 16 are shown. However, the structure and working details of column 14 are substantially identical to that shown herein as well.

Figure 3:
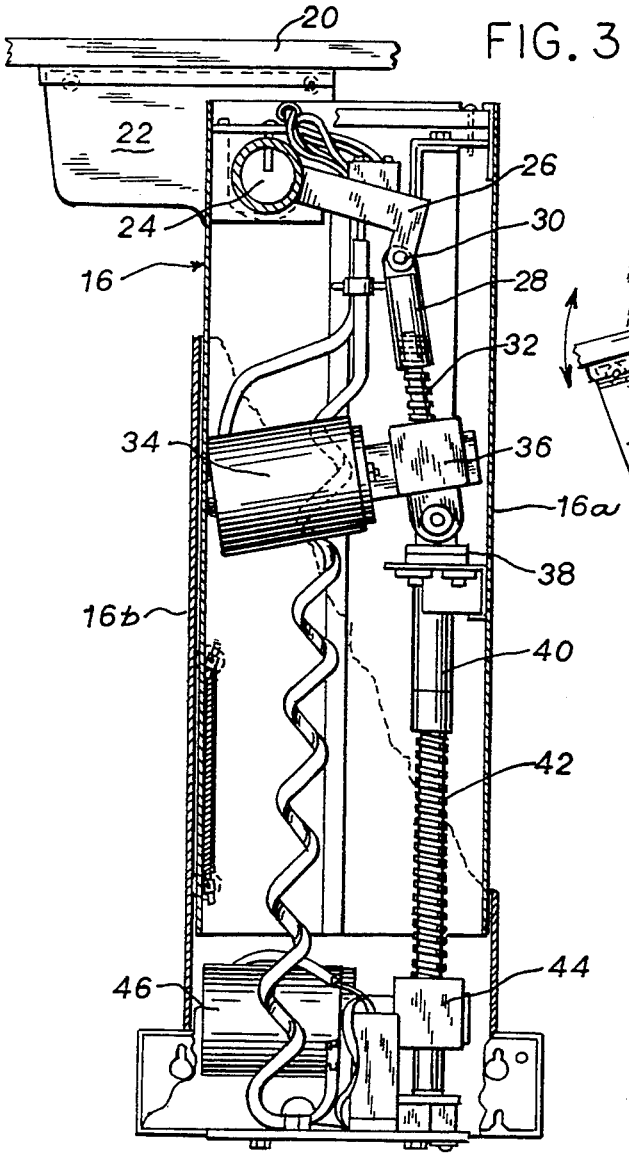
FIG. 3 is a fragmentary, sectional view taken along line 3—3 of FIG. 1, with the table top shown in a first position, with portions thereof broken away.

Table top 20, which is shown in FIG. 3 in fragmentary manner, is carried on an adjustable mounting mechanism including a pivotal mounting bracket 22, which, in turn, is mounted on pivot 24 carried on column 16 and defining a horizontal tilt axis for the table top 20. Pivot arm 26 is attached to pivotal mounting bracket 22 and communicates with an internally threaded tubular nut 28 through a second pivot 30. Rotatable lead screw 32 is provided, being operable by motor 34 so that as lead screw 32 rotates, tubular nut 28 moves inwardly or outwardly along the lead screw to cause pivot arm 26 to rotate. This, in turn, results in the pivoting of mounting bracket 22 and attached table top 20. Motor 34 is capable of operating in either direction to correspondingly cause pivoting of table top 20 in either direction.

Figure 4:
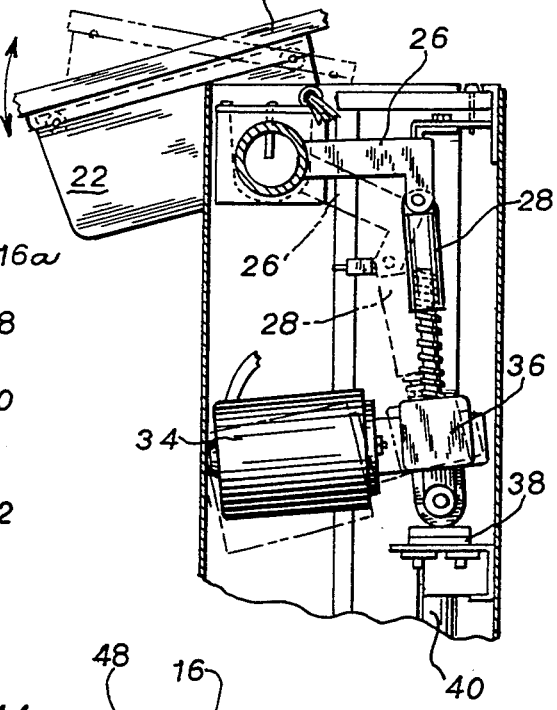
FIG. 4 is a fragmentary, sectional view similar to FIG. 3 showing the table top in other pivoting positions.
Figure 6:
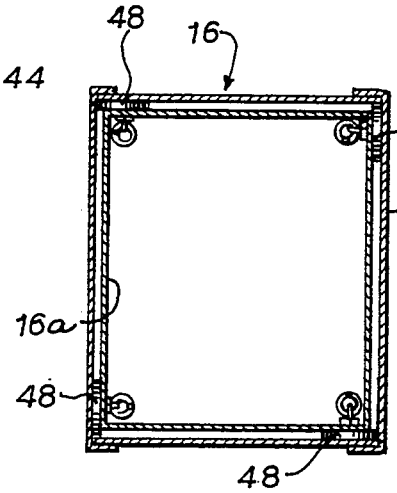
FIG. 6 is a sectional view of the vertical column taken along line 6—6 of FIG. 5.
Figure 5:
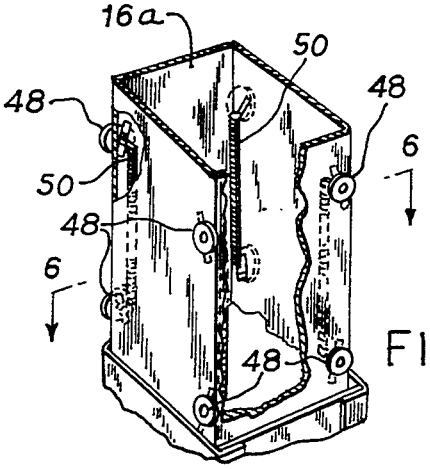
FIG. 5 is a broken away, perspective view of an inner portion of the movably extensible vertical column of the table shown.

FIG. 4 shows another position of the assembly described above as governed by operation of motor 34, with a further pivoting position being shown in phantom lines.

Motor 34 and its reducer 36 are carried on a platform 38, the upper end of which secures one end of a threaded tubular nut 40, the other end of which nut receives a second lead screw 42. This lead screw is carried in a second reducer 44 which is operated by a second electric motor 46. Second electric motor 46 and reducer 44 are bolted to the bottom of column 16.

Thus, when motor 46 through reducer 44 rotates lead screw 42 in either direction, tubular nut 40 is either raised or lowered. Platform 38 is connected to a tubular, inner, upper column member 16*a*, which fits in telescoping relation within outer lower column member 16*b*, so that, with the raising and lowering of platform 38 driven by motor 46, upper column member 16*a* is raised and lowered as well, along with table top 20 and the interconnecting parts.

It should be noted that in FIG. 3 a portion of lower column member 16*a* is shown in broken away configuration. In actuality, column 16*b* is in the form of a square cross section tube as shown in FIG. 1.

Figure 7:
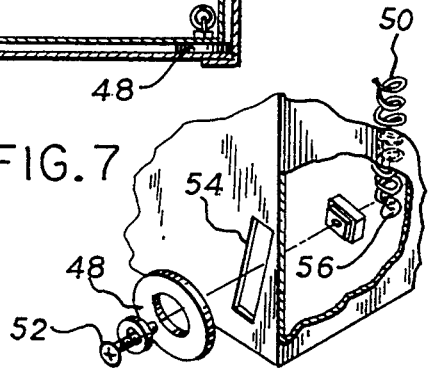
FIG. 7 is a fragmentary, perspective view of a portion of the vertical column shown in FIG. 5

Upper column member 16*a* carries optional spring-tensioned stabilizer wheels 48 which serve to facilitate the telescoping, sliding movement between upper column member 16*a* and lower column member 16*b*, in accordance with the disclosure of Kritske U.S. Pat. No. 4,381,095, which is incorporated herein by reference. As shown in FIG. 7, each roller 48 may be secured to tension spring 50 by means of bolt 52 and appropriate nuts and washers, with bolt 52 being positioned to be slidable in angled slot 54. The end of spring 50 may be welded onto the end of bolt 52, or may be retained within looped end 56 of the spring 50 at each end thereof.

Accordingly, a raisable and lowerable table is provided, preferably with two independently movable work surfaces such as table tops 18 and 20, which exhibits great versatility of use coupled with low cost of manufacture.

Figure 8:
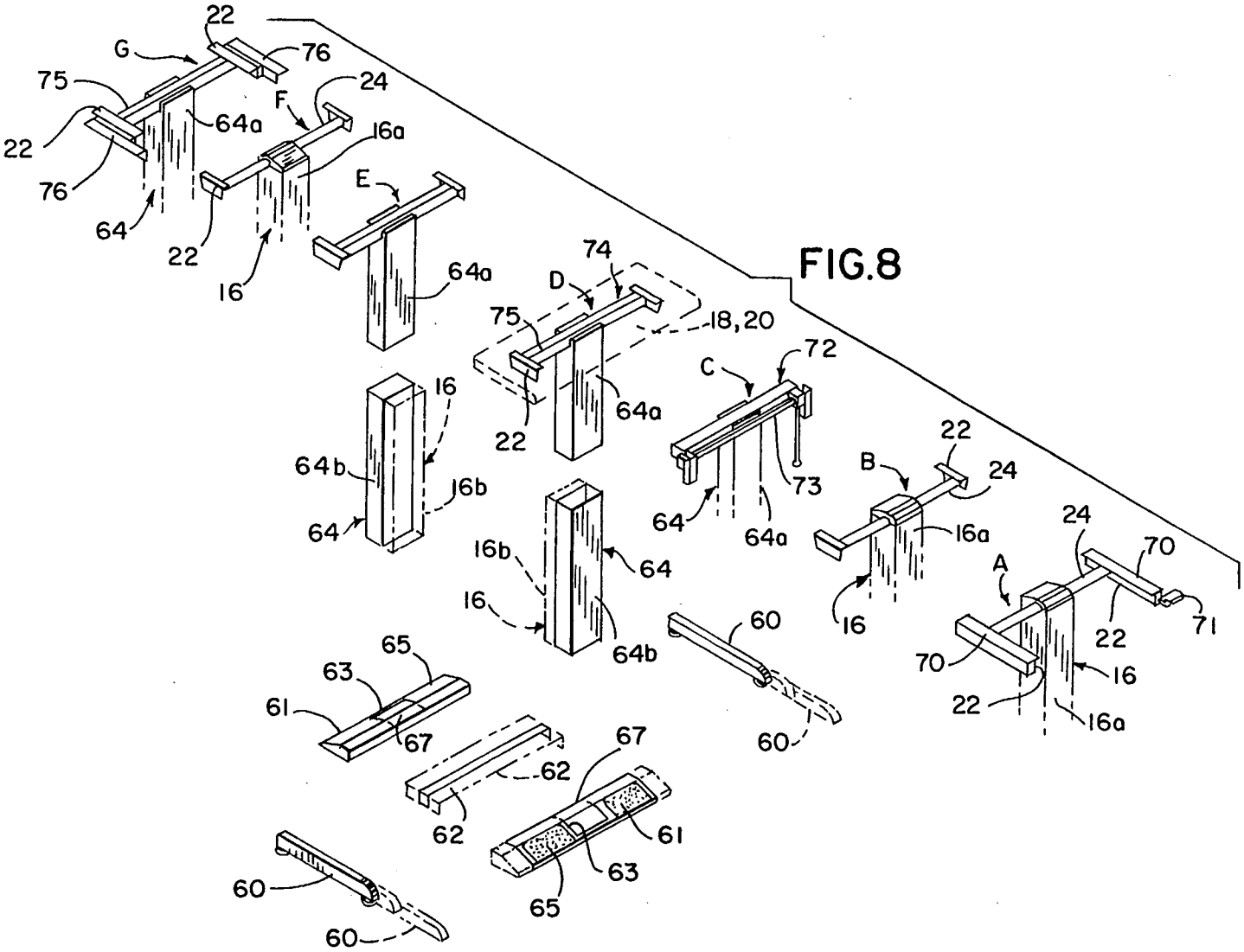
FIG. 8 is an exploded perspective view of the components of the modular assembly for an adjustable work station of the present invention.

Referring to FIG. 8, applicants have also found that a modular system for the assembly of adjustable work stations may be based on a work station utilizing the dual adjustable column construction identified hereinabove with various conventional and straightforward modifications, all of which may be supported on a common base. The modular assembly utilizes as a key element the telescoping tubular column 16, including a modification to add another degree of movement to the supporting surface such as a table top 18 or 20. Thus, the basic adjustable work station 10 described above comprises one modular work station which may be assembled in accordance with the system of the present invention to be described herein.

In FIG. 8, each of the varying modular work stations to be described is supported in a common base which utilizes a pair of laterally spaced horizontally disposed legs 60 which are interconnected by a pair of identical parallel spreaders 61 which are attached at their ends to the legs 60, preferably with welded connections. The spreaders 61 are normally spaced apart and the gap therebetween may be closed with a filler plate 62, as shown. Each of the spreaders 61 includes an upwardly opening slot 63 for receipt of the lower end of the column 16 or the optional modified column 64. Attachment of the columns to the spreaders is also preferably made with welded connections.

Column 64 is somewhat thinner or narrower in depth (front-to-back) than column 16, but otherwise is constructed in essentially the same manner. Thus, column 64 is of tubular telescoping construction and includes a vertically movable upper column member 64*a* and a fixed lower column member 64*b*. The lower column member 64*b* is sized to be received in the slot 63 in the sloping upper surface 65 of the spreader. The narrower column 64 is adapted to provide only powered vertical lift utilizing the motor driven lead screw actuator 40–46 shown in FIG. 3. Without the inclusion of the motor driven tilt mechanism 28–34, not as much interior space is required in the column 64. As described above, column 16 has a generally square horizontal cross section, whereas column 64 has a generally rectangular horizontal cross section. Each of the spreaders 61 includes a knock-out panel 67 in the horizontal upper surface 66. If it is desired in a modular assembly of a work station to utilize one or two columns 16 of larger cross section, the knock-out panel 67 is removed to provide the required enlarged slot 68 which will accommodate receipt of the fixed lower end 16*b* of the larger column.

The various schematic depictions of movable upper column members 16*a* and 64*a* shown extending across the top of FIG. 8 demonstrate the flexibility and broad utility which can be provided in a dual surface work station in which each of the work surfaces has a range of adjustability including one or all of vertical movement, tilting movement, and front-to-back sliding movement. Beginning with module A at the right of FIG. 8, column 16 of the type previously described includes a linear actuator for lifting the work surface by raising the upper column member 16*a* and the work surface or table top 18 attached thereto. Horizontal pivot 24 is attached to the upper column member 16*a* and includes a pair of pivot mounting brackets 22 to which the table top (not shown) is attached. Although all of the work surfaces (either 18 or 20) have been removed from the various modules shown in FIG. 8 for clarity, except for one such surface shown in phantom lines in module D, it will be understood that work surfaces of many shapes and sizes may be utilized for either the front or the back columns.

Module A also includes a slide mechanism by which the work surface 18 may be moved back and forth, front-to-back through a given range of movement in any vertical position of the table and in any position to which the table top may be tilted about the pivot 24. A pair of right and left hand slide brackets 70 are slidably attached to the respective mounting brackets 22 at each end of the pivot 24. The table top 18 is attached directly to the slide brackets 70. Selective positioning of the table top on the slide brackets 70 may be provided manually with a hand-operated slide control 71 in a manner well known in the art.

Module B includes the same larger column 16, but does not include slide brackets 70 of the type shown on module A. Thus, module B provides vertical and tilt adjustability to the table top, but not front-to-back sliding movement.

Module C utilizes the narrower column 64 including the movable upper column member 64*a* to the upper end of which is attached a modified table top mounting assembly 72. This mounting assembly includes attachment for a work surface, such as a table top 18 or 20, and includes a manual tilt assembly 73 by which the table top may be tilted about the horizontal longitudinal axis of the assembly and locked in its desired tilt position. Such a manual tilt assembly 73 is shown, for example, in U.S. Pat. No. 4,431,153. Module C also provides vertical lift movement by virtue of the powered lead screw actuator assembly 40–46 mounted within the column 64.

Module D includes the narrower column assembly 64 and provides only the basic vertical lift function. The work surface mounting assembly 74 includes a cross bar 75 rigidly attached to the upper end of the upper column member 64*a* and includes a pair of mounting brackets 22 which may be identical to those used with the horizontal pivot 24 in modules A and B. As with module B, the work surface is attached directly to the mounting brackets 22.

Modules A through D are shown principally for use on the forward column 16 or 64, however, all of the modules described and to be described may be mounted on the rear column of the adjustable work station, either in their forward orientations already described or turned 180° about a vertical axis from those forward orientations. Thus, referring to module E, it is identical in all respects to module D, except that it is turned 180° and shown positioned for attachment as the rear column 64 of the assembly. Similarly, module F is identical to module B, except for its reverse positioning on the rear column 16. Because of the relative horizontal positioning between a table top 18 or 20 and its respective mounting brackets 22, such that one edge of the respective table top is closer to the mounting bracket than its opposite edge, similar or identical columns may be utilized on the same work station (with one rotated 180° with respect to the other) without interference between the work surfaces.

Figure 9:
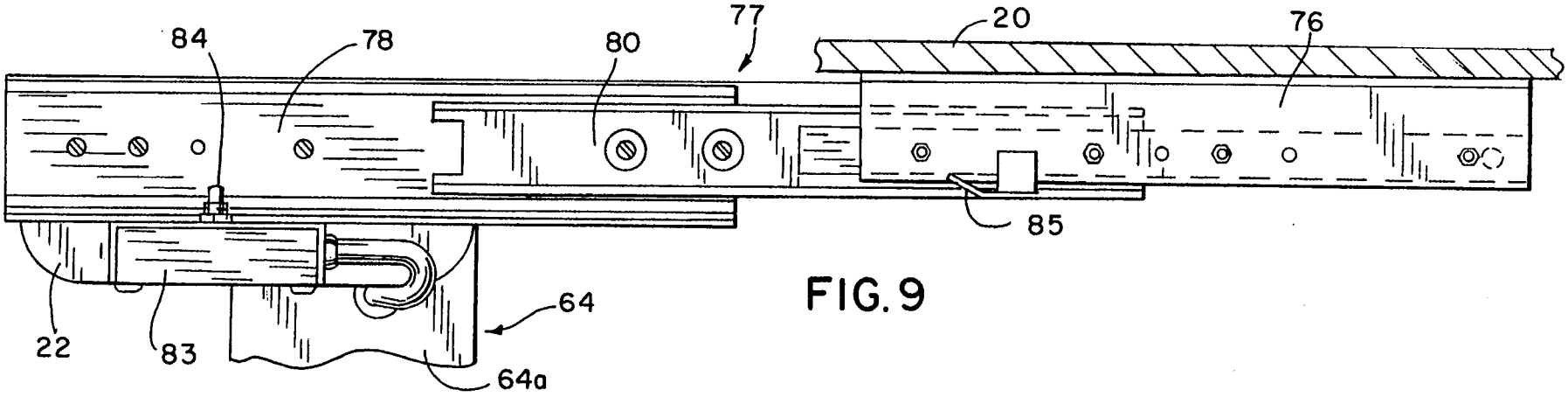
FIGS. 9 and 10 are partial side elevations of the lock-out limit switch used with the slide mechanism for the work surface in one embodiment of the invention.
Figure 10:
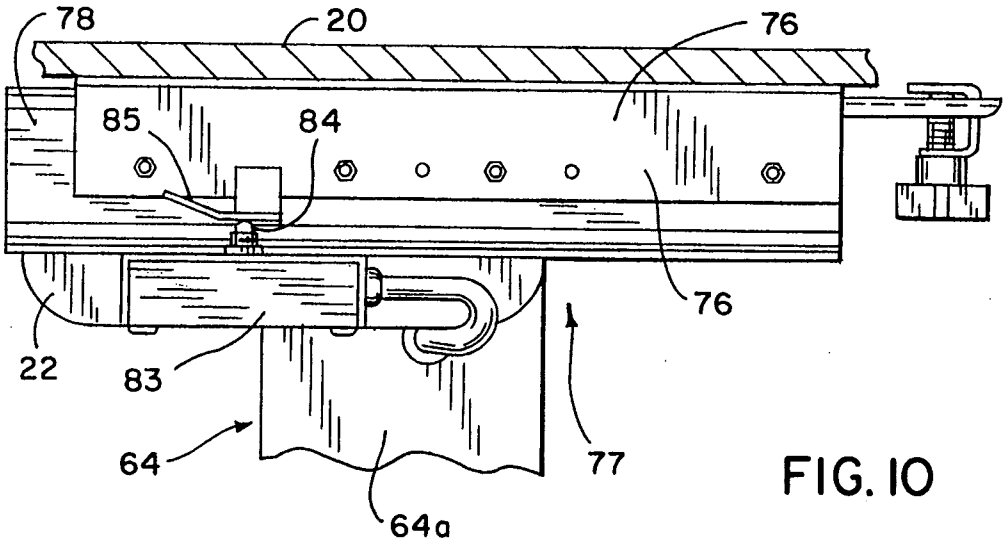
Figure 11:
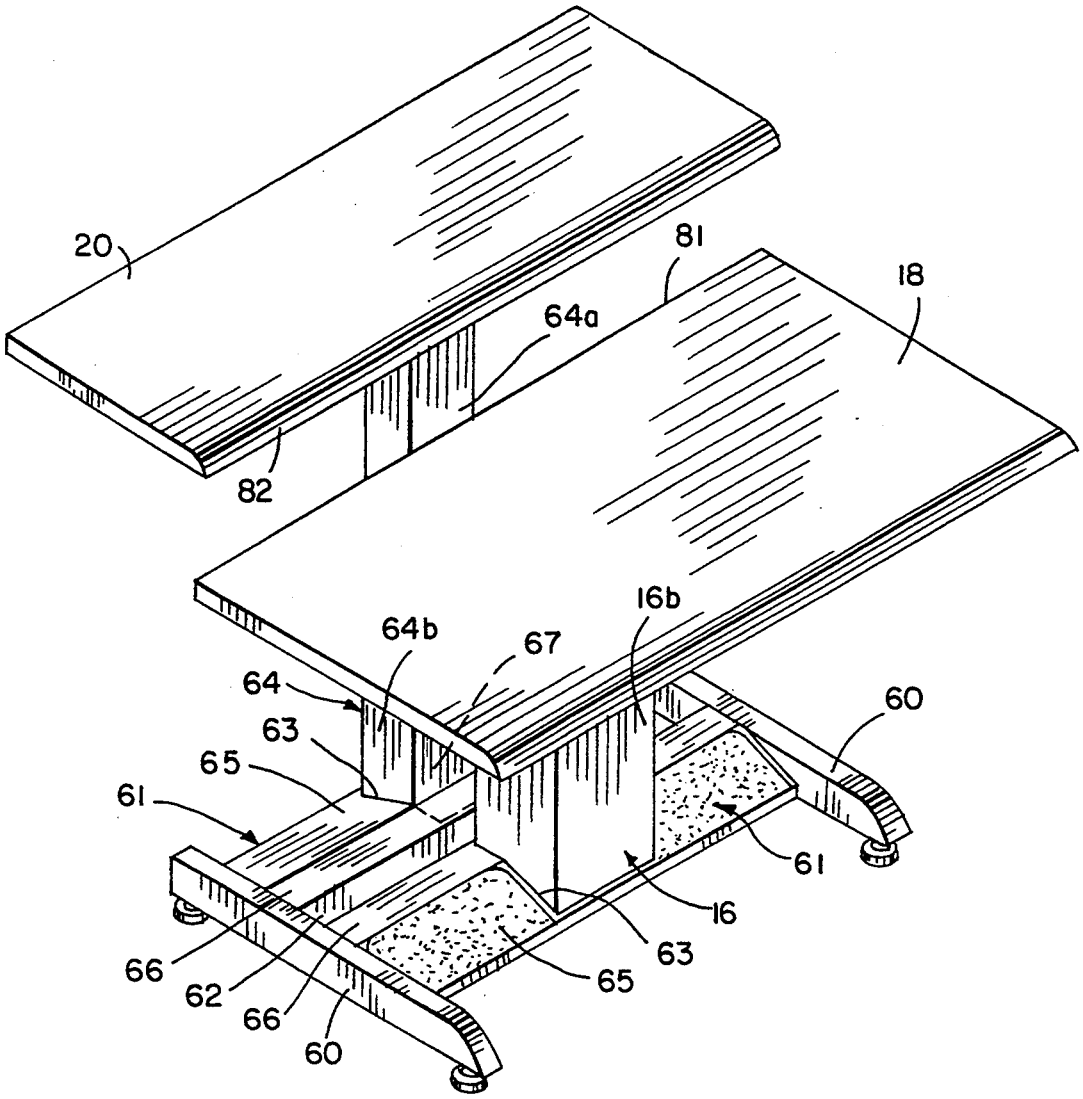
FIG. 11 is a perspective view of one assembly of a modular work station shown in FIG. 8.

Module G is similar to module D and utilizes the narrower supporting column 64. Module G includes the same powered lift system as in each of modules A–F and has the same rigid cross bar 75 as used in module D so that no pivotal table top movement is provided. However, the mounting brackets 22 at the ends of the cross bar 75 each includes a slide bracket 76 to which the table top 18 or 20 is directly attached to provide front to back sliding movement in a manner similar to that described with respect to module A. Details of the slide assembly 77 utilizing slide brackets 76 are shown in FIGS. 9 and 10. Referring to those figures, each fixed mounting bracket 22 has attached thereto a fixed slide bracket 78 into which is telescoped an intermediate slide bracket 80 and into which, in turn, is slid slide bracket 76 to which the table top 20 is attached. Referring also to FIG. 11, the rear table top 20 utilizing a module G construction, is shown in its normal position with the table top moved to the rear, as also shown in FIG. 10. In this position of the rear surface 20, the front surface 18 which is mounted on column 16 may be lifted vertically or tilted without any interfering contact between the rear edge 81 of the front surface 18 and the front edge 82 of the rear surface 20. In this home position of the rear table surface 20, a limit switch 83 attached to the fixed slide bracket 78 includes a switch button 84 which is depressed and closed by an actuating ramp 85 carried on slide bracket 76. When the limit switch 83 is closed, all electrical circuits powering the lift and tilt mechanism for the front table surface, as well as the lift mechanism powering the rear table surface (and tilt mechanism if also included) remain fully operative. However, if the rear table surface 20 is slid forwardly so that its front edge 82 passes the vertical plane containing the rear edge 81 of the front table surface, limit switch 83 will be opened and vertical and tilting movements of the two surfaces 18 and 20 are prevented.

Each of the legs 60, spreaders 61 and filler plate 62 may be made of increased length or width to accommodate larger and/or wider table tops 18 and 20. Such larger size elements are shown in dashed lines in the lower portion of FIG. 8. The use of welded connections between the legs and spreaders, as well as between the spreaders and columns as indicated above, enhances the utility and economy of the modular assembly system of the present invention. Welded connections can essentially be made wherever required to accommodate varying sizes and shapes of the work station components, thereby eliminating the need for varying bolt hole patterns and related discrete connectors, brackets and the like.

Various modes of carrying out the present invention are contemplated as being within the scope of the following claims particularly pointing out and distinctly claiming the subject matter which is regarded as the invention.

We claim:

1. A work station having a pair of independently adjustable work surfaces having parallel adjacent edges, at least one of which work surfaces is supported by a separate vertically telescoping column including a movable upper tubular column member and a fixed lower tubular column member and with both work surfaces supported on a common base, the improvement comprising:

adjustable mounting means for attaching one work surface to the upper end of the upper column member;

first actuator means secured within one lower column member, extending upwardly through the corresponding upper column member and into operative engagement with said mounting means for moving the attached work surface vertically;

second actuator means secured within said corresponding upper column member, extending upwardly into operative engagement with said mounting means for pivoting the attached work surface about a horizontal axis parallel to the surface;

said mounting means for at least one of said work surfaces including means for moving said work surface relative to its supporting column in a direction in the plane of said surface; and, said moving means including lockout means for disenabling operation of said actuator means in response to movement of one of the adjacent edges of said work surfaces through a vertical plane containing the other of said edges.

2. The work station as set forth in claim 1 wherein said first and second actuator means comprise linear actuators.

3. The work station as set forth in claim 1 wherein the other of said work surfaces is supported by a second vertically telescoping column including a movable upper tubular column member and a fixed lower tubular column member.

4. The work station as set forth in claim 3 including second adjustable mounting means for attaching the other of said work surfaces to the upper end of the upper column member for said second vertically telescoping column.

* * * * *